United States Patent [19]

Hour

[11] Patent Number: 4,983,062

[45] Date of Patent: Jan. 8, 1991

[54] PEN HOLDER WITH PUZZLE BLOCKS

[76] Inventor: Jenn-Chyan Hour, No. 42, Sec. 2 Da-Feng Road, Tantzu Hsiang, Taichung Hsien, Taiwan

[21] Appl. No.: 513,226

[22] Filed: Apr. 23, 1990

[51] Int. Cl.[5] ..... A43K 29/00; A63F 9/08

[52] U.S. Cl. ..... 401/195; 273/153 S

[58] Field of Search ..... 273/153 S, 155; 401/195, 88

[56] References Cited

U.S. PATENT DOCUMENTS 753,266 3/1904 Hubbard ..... 273/153 S

FOREIGN PATENT DOCUMENTS 1038961 9/1958 Fed. Rep. of Germany ..... 401/195

1319888 6/1987 U.S.S.R. ..... 273/153 S 2182855 5/1987 United Kingdom ..... 273/153 S

*Primary Examiner*—Richard J. Johnson

*Attorney, Agent, or Firm*—Bacon & Thomas

[57] ABSTRACT

A pen holder with puzzle blocks comprises a plurality of rotatable blocks on a holder stem with all lateral faces providing a groove respectively, a plurality of sliding pieces with different colors, numbers, or figures on the upper faces. The plurality of sliding pieces are fitted with the plurality of rotatable blocks on the grooves at all lateral faces and one of the grooves is left as a vacancy. During operation, the plurality of rotatable blocks are turned, respectively, and the vacancy is filled with an adjacent sliding piece. The process is continued until the four lateral sides of the pen holder are each aligned with one distinguishable color, number or figure.

8 Claims, 5 Drawing Sheets

PEN HOLDER WITH PUZZLE BLOCKS

BACKGROUND OF THE INVENTION

The invention relates to a pen holder with puzzle blocks. More particularly, the invention relates to a pen holder which may be used not only for writing but also for playing a puzzle game.

A conventional pen holder usually includes a body stem with a smooth outer surface or a polygonal outer surface that is conveniently and comfortably held by the user. Newer types of pen holders are known for their innovative appearance or assembly of parts for forming a new construction. It is unknown to provide a pen holder with additional functions.

SUMMARY OF THE INVENTION

An object of the present invention is to provide a pen holder which may be used as a toy for playing a puzzle game.

The present invention provides a pen holder with puzzle blocks, which comprises a body stem, a plurality of rotatable blocks, and a plurality of sliding pieces. The body stem is of hollow tube shape to connect with the cap socket at the upper end and with the nib socket at the lower end. Each of said plurality of rotatable blocks may be of cylindrical, cubic, or polyhedron shape, with an axial through hole in the middle and is provided with a groove on each of its lateral faces. Each groove may be a dovetail groove, or with two upright lateral sides having straight right angled or arcuate corners. Said plurality of rotatable blocks are rotatably fitted with the body stem in a side by side manner. Each of said plurality of sliding pieces is of plate shape corresponding to the shape of said groove on the lateral face of the rotatable block for slidably fitting within said groove on each of said plurality of rotatable blocks.

In one of the preferred embodiments of the present invention, the pen holder with puzzle blocks provides a pen holder on which said plurality of sliding pieces may be provided with different distinguishable colors, numbers, or figures so that sliding pieces with the same color, number, or figure may be arranged to line up with one another to provide an interesting puzzle game.

In another preferred embodiment of the present invention, the pen holder with puzzle blocks includes a pen holder on which a plurality of rotatable blocks are fitted with each other so that a player may turn said plurality of rotatable blocks during playing of a puzzle game.

In yet another preferred embodiment of the present invention, the pen holder with puzzle blocks provides a pen holder on which a plurality of sliding pieces are filled within all except one of the grooves on each of said plurality of rotatable blocks so that a player may move said plurality of sliding pieces during playing of a puzzle game.

By means of an optional groove on one of said plurality of rotatable blocks being left vacant and the multiple operations of moving said plurality of sliding pieces and turning said plurality of rotatable blocks, a puzzle game may be carried out on said pen holder in addition to the writing function.

BRIEF DESCRIPTION OF THE DRAWINGS

The invention will be further illustrated by way of example, with reference to the accompanying drawings in which.

DETAILED DESCRIPTION OF THE PREFERRED EMBODIMENTS

Figure 1:
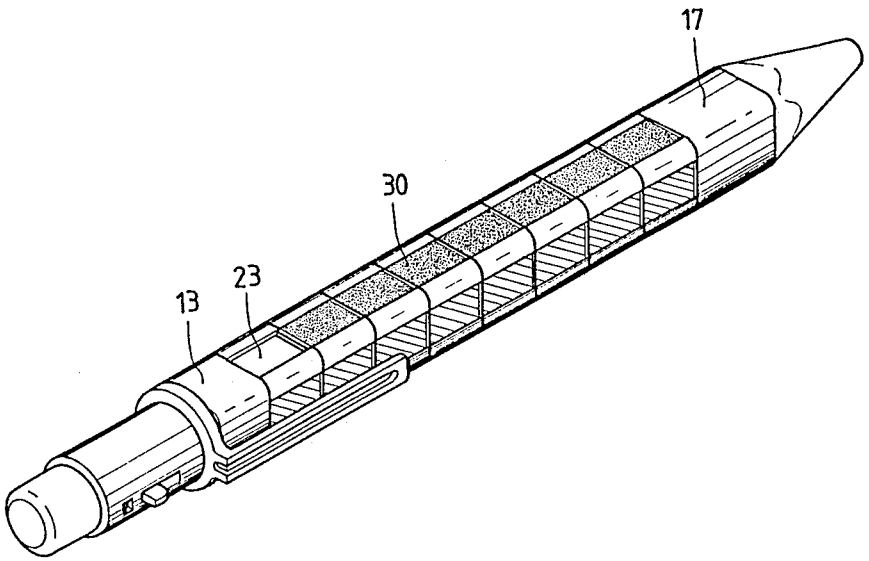
FIG. 1 is a perspective view of a pen holder with puzzle blocks according to the invention.
Figure 2:
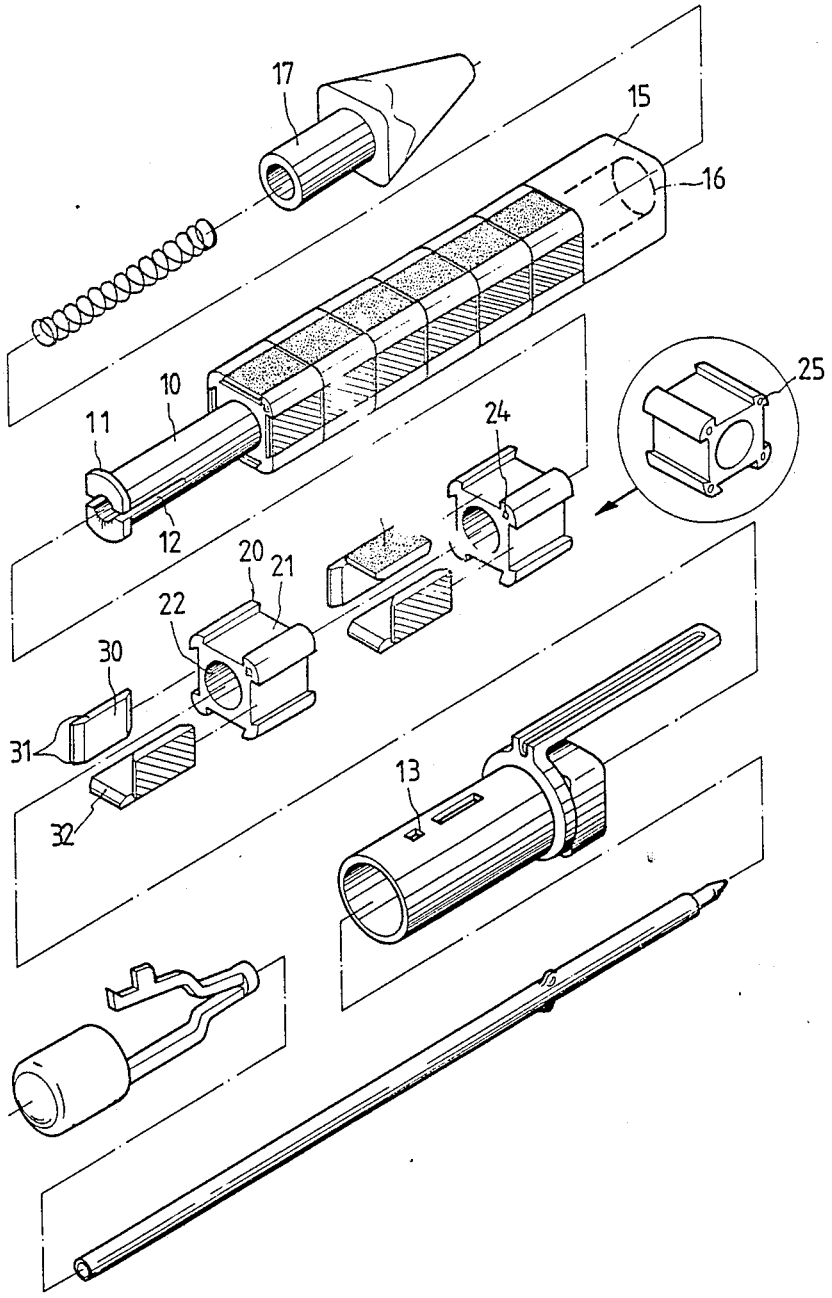
FIG. 2 is an exploded perspective view of the pen holder with puzzle blocks shown in FIG. 1.
Figure 3:
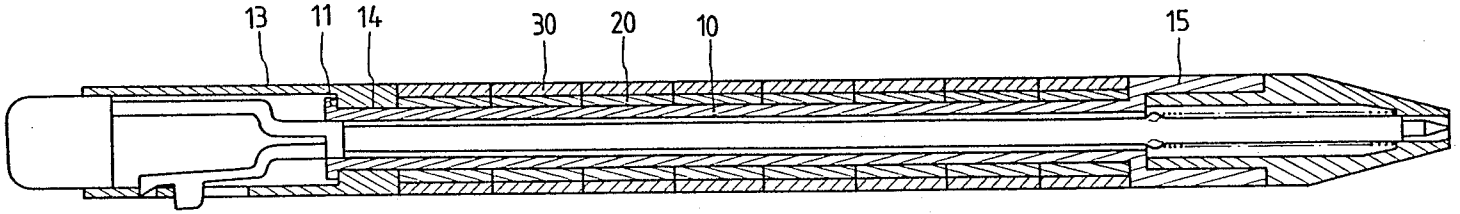
FIG. 3 is a longitudinal sectional view of the pen holder with puzzle blocks shown in FIG. 1.

Referring to FIGS. 1–5, a holder stem 10 is tube shape to receive the core of a pen. A flange 11 is provided at the top end of said holder stem 10 and an open slot 12 is provided by the flange end and axially extend along said holder stem 10 a distance to result in the top part being formed as a split open head. A cap socket 13 has a neck part which is provided with a smaller inner hole 14. When the top end of said holder stem 10 is fitted within said cap socket 13, said flange 11 may be properly retained against said neck part because of the flexibility of said split open head. A push head and a clamp may be fitted with said cap socket 13 to constitute a pen head end. The lower end of said holder stem 10 has an expanded neck part 15 with a through hole 16 for receiving a nib socket 17. Said nib socket 17 is used to receive a spring and a nib.

Each of a plurality of rotatable cubic blocks 20 is provided with an identical axial through hole for assembling on said holder stem 10 and between said nib socket 17 and said cap socket 13. Each of said plurality of rotatable cubic blocks 20 is also provided with a dovetail groove 21 on four lateral surfaces, at least one extrusion or tenon 24 on one end face and at least one mortise or cavity 25 on the opposite end face for detachably securing adjacent blocks 20 together.

A plurality of identical sized sliding pieces 30 are provided, with each sliding piece 30 being distinguishable by means of providing one of four different colors on an upper face thereof. Said plurality of sliding pieces 30 are slidably fitted with said plurality of dovetail grooves 21 on said plurality of rotatable cubic blocks 20. Two lateral sides of each sliding piece 30 are slidably fitted within each dovetail groove 21. Both front and back sides of each sliding piece 30 are provided with a slanted inwardly directed chamfer.

Figure 4:
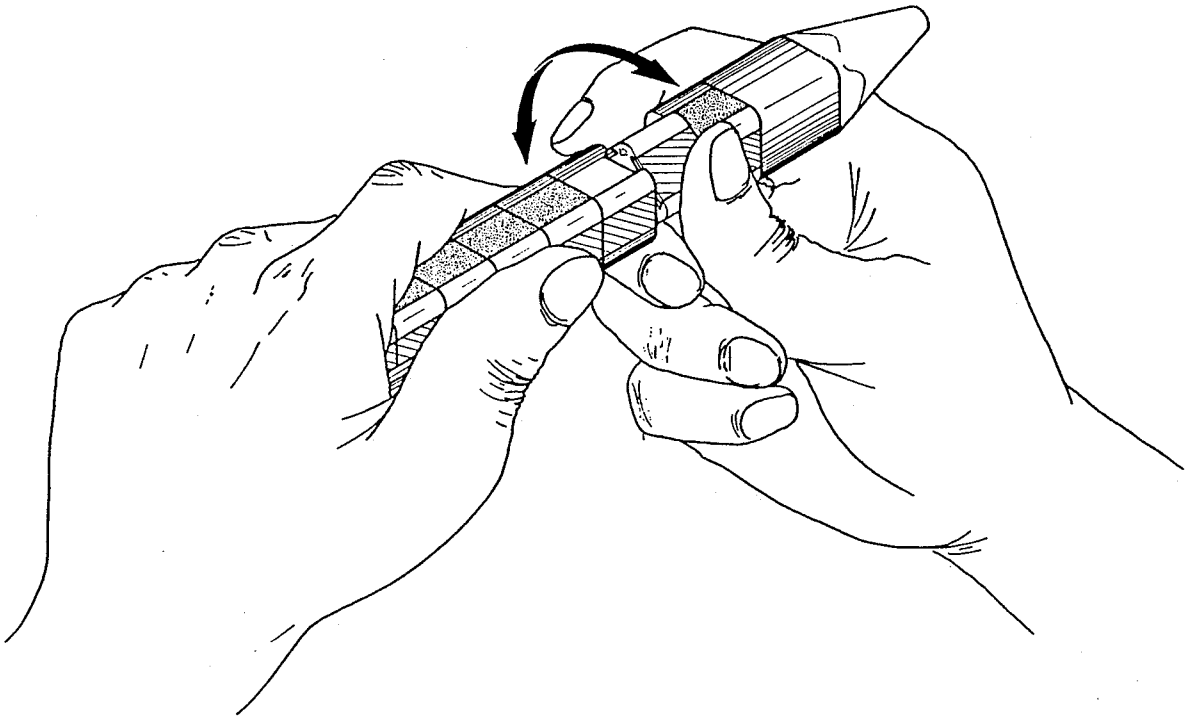
FIG. 4 is a perspective view illustrating the rotatable blocks shown in FIG. 1 being turned by the user.
Figure 5:
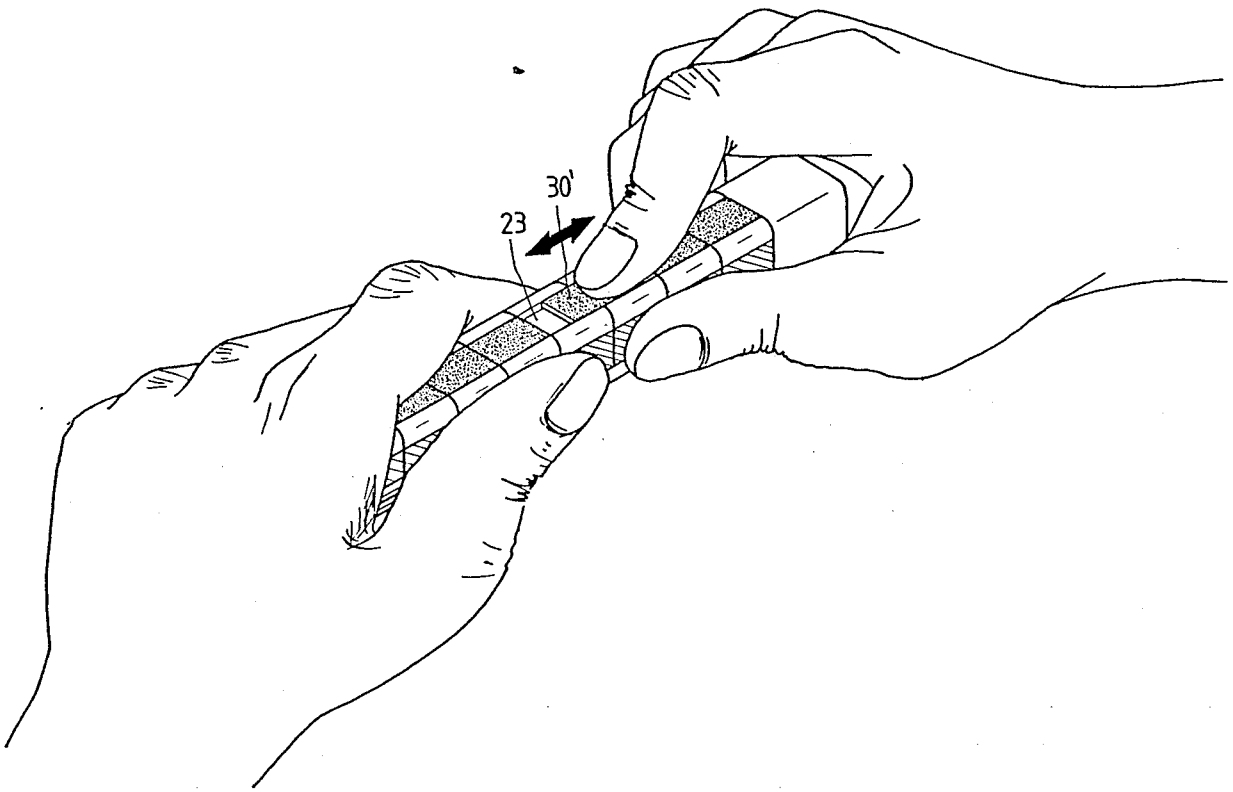
FIG. 5 is a perspective view illustrating a sliding piece shown in FIG. 1 being moved within a vacant groove.

While operating the puzzle blocks on said pen holder according to the invention, a vacant groove 23 on an optional dovetail may be initially provided, as shown in FIG. 5. Then, a sliding piece 30' adjacent said groove 23 may be slid therein to fill the vacancy and form another adjacent vacant groove. In this way, the sliding pieces 30 which are lined up on the same side are movable along a common axial direction. In the meantime, any rotatable block 20 may be turned with respect to the axis of the pen holder as shown in FIG. 4 to change the location of the sliding pieces 30 on the same rotatable block 20 so as to match the colors of the sliding pieces 30 on the other rotatable block 20. By repeatedly moving these sliding pieces 30 and turning these rotatable blocks 20, the sliding pieces 30 having the same color may be lined up on the same side. Therefore, multiple operations of moving said plurality of sliding pieces 30 and turning said plurality of rotatable blocks 20 which make the four lateral sides of the pen holder, with one distinguishable color on each side, respectively, will offer an interesting and puzzling game for players.

By means of the illustrated embodiment described above, it can be understood that the pen holder with puzzle blocks according to the invention is not only for holding while writing, but also for playing a puzzle game while not being used in writing. It is noted that any changes and modifications, without departing from the scope of the claims, are still within the spirit of the invention.

I claim:

1. A pen holder with puzzle blocks, wherein the pen holder is of the type including a cap socket having a neck portion and a push head, a nib socket having a nib and spring, and a stem portion, the improvement comprising:

(a) the stem portion including a hollow stem body provided with a top end defined by a split open head and a flange, and a lower end defined by an expanded hollow neck portion, the top end being flexibly retained with the neck portion of the cap socket and the lower end being connected with the nib socket;

(b) a plurality of blocks, each block being provided with an identical axial hole therethrough and a plurality of grooves on a plurality of exterior faces thereof, the blocks being rotatably assembled on the stem body;

(c) a plurality of sliding pieces, each sliding piece being provided with a distinguishing feature on an upper face thereof and being slidably secured within a corresponding groove of each block, with a single groove being unoccupied by a sliding piece; and (d) wherein an adjacent sliding piece may be slid into the unoccupied groove to define a new unoccupied groove which may be filled by another adjacent sliding piece and the blocks may be rotated relative to each other for aligning sliding pieces with the same distinguishing features together.

2. The pen holder with puzzle blocks of claim 1 wherein the rotatable blocks are all of cylindrical, cubic or polyhedron configuration.

3. The pen holder with puzzle blocks of claim 1 wherein each rotatable blocks includes a pair of opposed end faces, one end face being provided with at least one tenon and the other end face being provided with at least one mortise so that adjacent blocks provided with corresponding tenons and mortises may be detachably secured to one another.

4. The pen holder with puzzle blocks of claim 1 wherein each groove and each sliding piece are correspondingly configured to define a dovetail connection therebetween.

5. The pen holder with puzzle blocks of claim 4 wherein the dovetail configuration includes a pair of lateral sides defined by corresponding right angle configurations.

6. The pen holder with puzzle blocks of claim 4 wherein the dovetail configuration includes opposite grooves of an arcuate configuration.

7. The pen holder with puzzle blocks of claim 1 wherein each sliding piece includes opposed edges, with each edge being provided with an inwardly slanted chamfer for facilitating the sliding of the piece within the grooves of the rotatable blocks.

8. The pen holder with puzzle blocks of claim 1 wherein the distinguishing feature is a color, a number or a figure thereon.

* * * * *